US006482061B1

(12) United States Patent
Matsuba et al.

(10) Patent No.: US 6,482,061 B1
(45) Date of Patent: Nov. 19, 2002

(54) METHOD FOR PRODUCING LAMPS

(75) Inventors: Tetsuo Matsuba, Osaka (JP); Shinichiro Ishitsuka, Osaka (JP); Shiro Iida, Osaka (JP); Masaru Oyaizu, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/564,147

(22) Filed: May 3, 2000

(30) Foreign Application Priority Data

May 25, 1999 (JP) ..... 11-144502

(51) Int. Cl.[7] ..... H01J 9/30
(52) U.S. Cl. ..... 445/23; 219/121.46
(58) Field of Search ..... 445/23; 219/121.46

(56) References Cited

U.S. PATENT DOCUMENTS 3,897,124 A * 7/1975 Pagnotta et al. ..... 439/734

FOREIGN PATENT DOCUMENTS

JP 62-73552 4/1987

* cited by examiner

*Primary Examiner*—Kenneth J. Ramsey
(74) *Attorney, Agent, or Firm*—Merchant & Gould P.C.

(57) ABSTRACT

A method for producing a lamp includes forming a tubular portion that is protruded in an end of an eyelet of a base of a lamp; drawing a lead wire for supplying power out of the tubular portion; and fusing the lead wire and the tubular portion with the eyelet by plasma arc welding. This ensures that plasma arc can be discharged to the protruded tubular portion, and therefore the tubular portion and the lead wire are fused with the eyelet of the base satisfactorily and stably. In the present invention, a tubular sleeve can be used in place of the tubular portion.

3 Claims, 3 Drawing Sheets

METHOD FOR PRODUCING LAMPS

BACKGROUND OF THE INVENTION

1. Field of the Invention

The present invention relates to a method for connecting a lead wire and a lamp base of a lamp.

2. Description of the Prior Art

Conventionally, an incandescent lamp, a reflex lamp, a high-pressure discharge lamp, and a bulb-shaped fluorescent lamp are known as bulb-shaped lamps provided with a screw base or a bulb-shaped lamp base. For example, in a bulb-shaped fluorescent lamp, a lead wire for connecting a ballast circuit and a base is connected to an eyelet provided at the end of the base on the side of the base by soldering.

However, the connection with solder has a disadvantage in that a flux (resin) used for soldering may be formed into a film on a surface of the base end after the connection with solder and may cause corrosion or connection failure.

In recent years, as a connection method that avoids the use of lead for the environment protection purposes, a method using plasma arc welding to connect the base end and the lead wire has been under examination, and a technique for connecting the lead wire and the base with a plasma arc also is known (JP 62-73552A).

Generally, in the vicinity of the hole of the base through which the lead wire is drawn out, the end of the eyelet in the base is folded inwardly by drawing so as to prevent the lead wire from falling out of the base. For this reason, the top of the eyelet is substantially flat.

Then, a conductive shield plate having a hole is provided on the eyelet while the lead wire is latched on the folded portion at the hole of the eyelet. Then, the eyelet and the shield plate are electrically connected so that discharge is caused from a plasma nozzle onto the eyelet in the hole of the shield plate so as to generate a plasma arc. Thus, the lead wire and the eyelet of the base are fused by plasma arc welding.

However, the plasma arc can be generated in any position in the eyelet (which becomes conductive through the shield plate) or the shield plate itself. Therefore, it has been difficult to cause discharge stably in a position where the lead wire and the eyelet can be fused.

SUMMARY OF THE INVENTION

Therefore, with the foregoing in mind, it is an object of the present invention to provide a method for producing a lamp that allows the lead wire to be fused with the base stably and satisfactorily by plasma arc welding.

A first method for producing a lamp of the present invention includes forming a tubular portion that is protruded in an eyelet of a base of a lamp; drawing a lead wire out of the tubular portion; and fusing the lead wire and the tubular portion with the eyelet by plasma arc welding. The protrusion of the eyelet in a tubular shape ensures that plasma arc is discharged to the protruded tubular portion. Further, the heat thereof melts the tubular portion and the lead wire so that the lead wire can be fused with the eyelet of the base satisfactorily and stably.

A second method for producing a lamp of the present invention includes mounting a sleeve onto a lead wire drawn out of an eyelet of a base of a lamp; and fusing the lead wire and the sleeve with the eyelet by plasma arc welding. This embodiment allows the use of a base having a conventional eyelet shape and ensures the plasma arc is discharged to the sleeve. Further, the discharge generates plasma, and the heat thereof melts the sleeve and the lead wire so that the lead wire can be fused with the eyelet of the base satisfactorily and stably.

It is preferable that the first and second methods for producing a lamp include placing a shield plate on the eyelet, the shield plate having a hole and provided with an insulator having an opening in the hole, in such a manner that the tubular portion or the sleeve is inserted into the opening of the insulator, before the process of fusing the lead wire and the tubular portion or the sleeve with the eyelet by plasma arc welding. This embodiment allows plasma arc to be discharged to the tubular portion or the sleeve stably, so that welding quality can be improved.

These and other advantages of the present invention will become apparent to those skilled in the art upon reading and understanding the following detailed description with reference to the accompanying figures.

DESCRIPTION OF THE PREFERRED EMBODIMENTS

Figure 1:
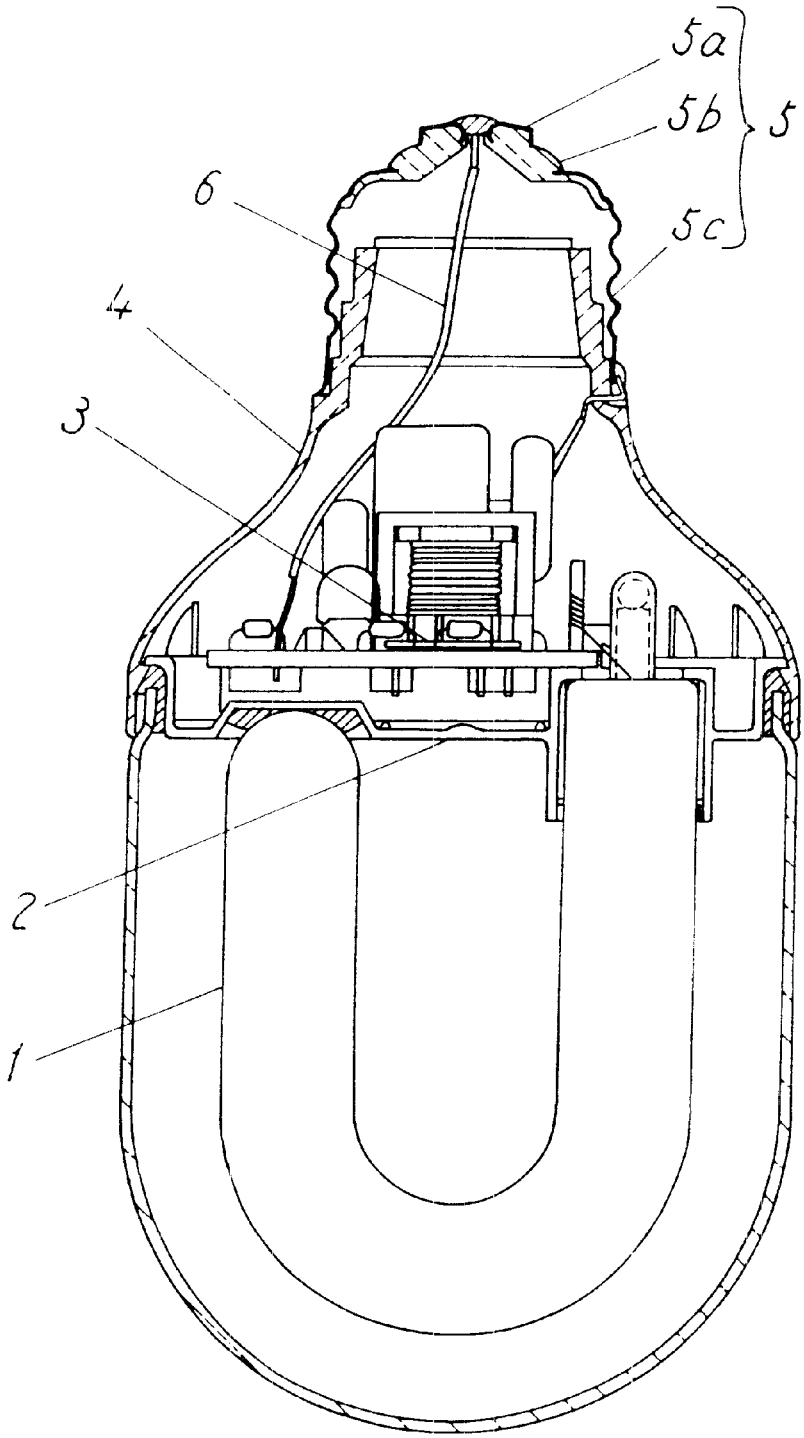
FIG. 1 is a partial cutaway front view of a bulb-shaped fluorescent lamp of an embodiment of the present invention.

Hereinafter, an embodiment of a method for producing a lamp of the present invention will be described with reference to a bulb-shaped fluorescent lamp provided with a bulb-shaped lamp base as shown in FIG. 1.

The bulb-shaped fluorescent lamp shown in FIG. 1 includes a fluorescent tube 1 that is curved, for example in a double U shape, a holder 2 for holding the fluorescent tube 1, a ballast circuit 3 for lighting the fluorescent tube 1, and a case 4 that houses the ballast circuit 3, includes a base 5 and defines an envelope in combination with a globe. A lead wire 6 for supplying power to the ballast circuit 3 is connected to the base 5. The base 5 includes an eyelet 5*a*, an eyelet glass 5*b* and a screw base 5*c*. The eyelet 5*a* is provided in the end of the base, and the eyelet 5*a* and the lead wire 6 are fused by plasma arc welding.

Figure 2:
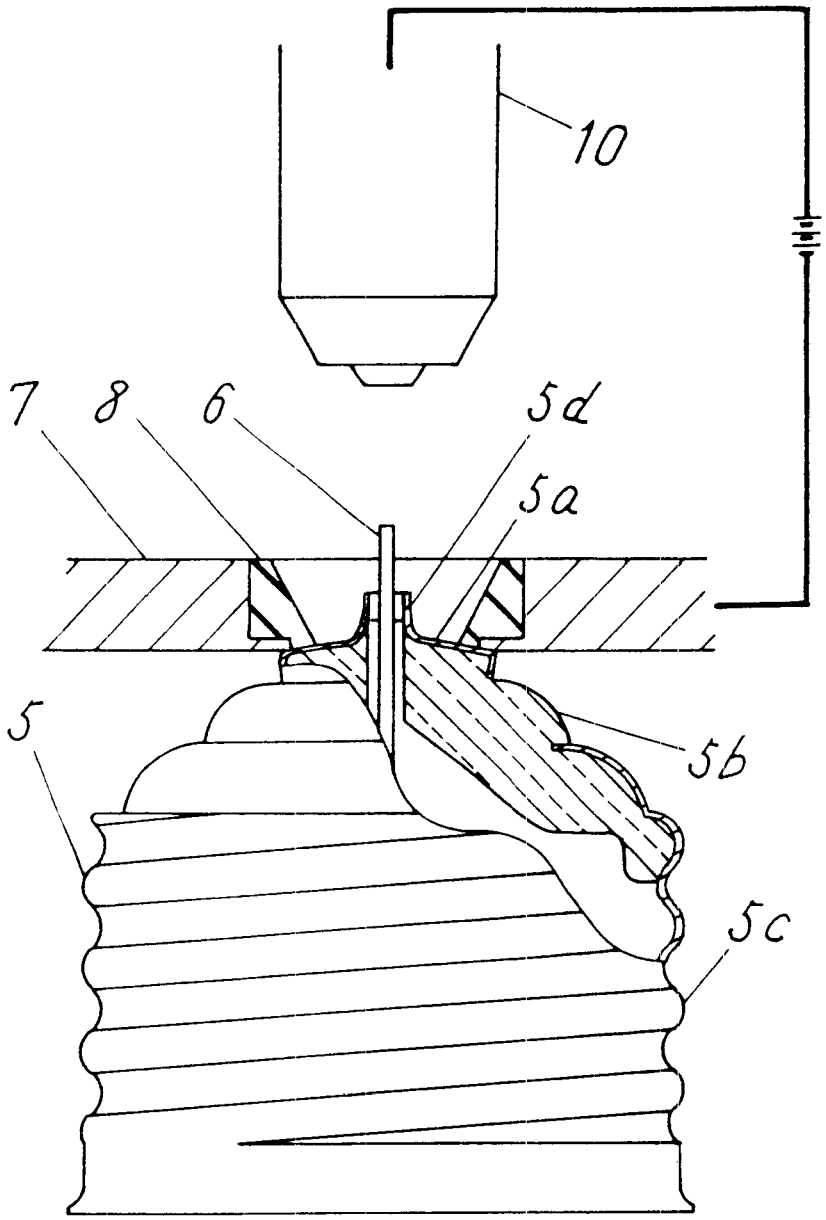
FIG. 2 is an enlarged cutaway front view of a bulb-shaped fluorescent lamp of an embodiment of the present invention.
Figure 3:
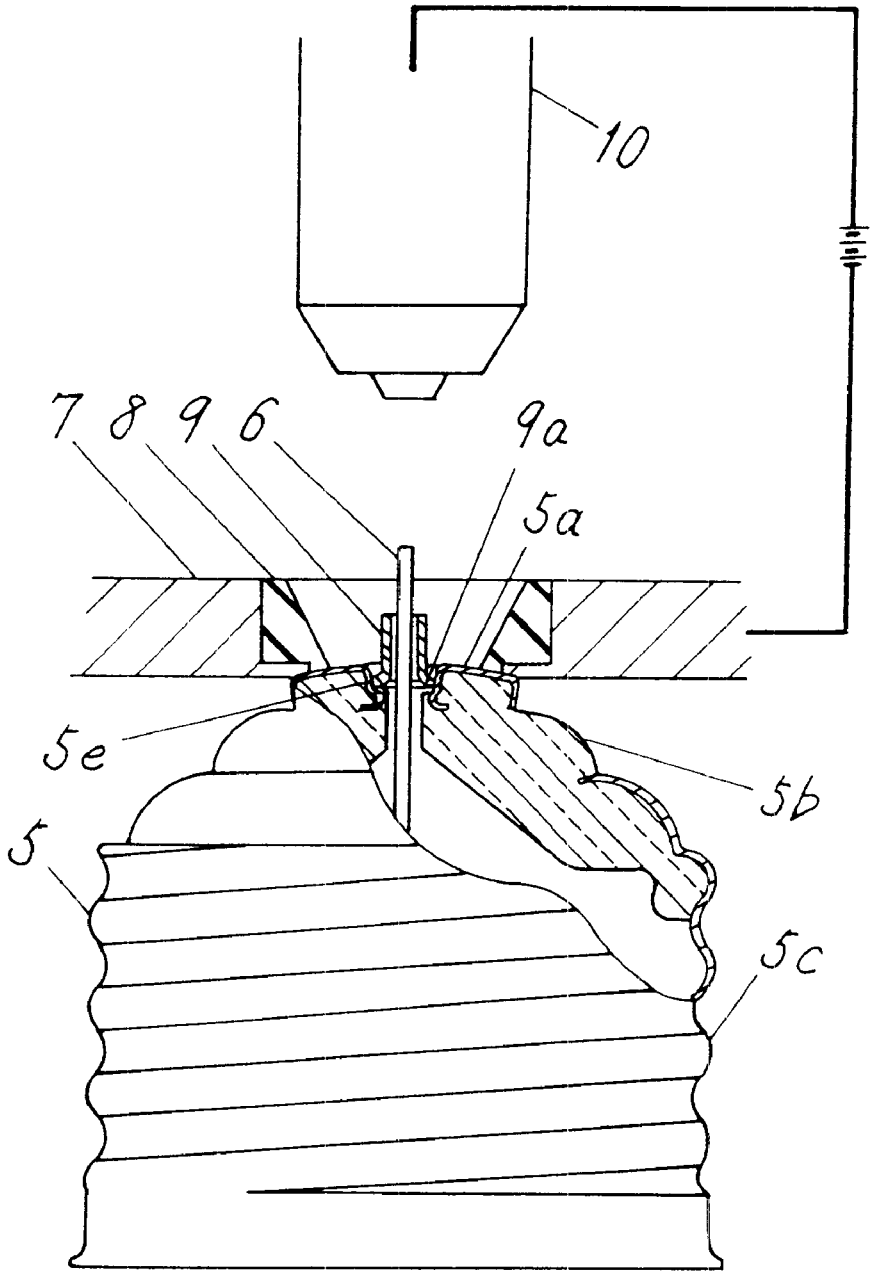
FIG. 3 is an enlarged cutaway front view of a bulb-shaped fluorescent lamp of an embodiment of the present invention.

The top of the eyelet 5*a* is formed by press molding in the shape of a circular arc with a slightly protruded center, as shown in FIG. 2 or 3, to ensure the contact with a socket of a lighting fixture.

As shown in FIG. 2, the disc-like eyelet 5*a* with a diameter of 10 mm is provided at the end of the base 5, and has an outwardly protruded tubular portion 5*d* in the center thereof The tubular portion 5*d* has a height of 1.0 to 2.0 mm and is provided with a hole through which the lead wire 6 extending from the ballast circuit 3 is drawn out. The lead wire 6 is projected 1 mm to 3 mm from the hole of the tubular portion 5*d* to the outside of the base 5. Thereafter, as described later, plasma arc welding is performed so that the lead wire 6 is fused with the eyelet 5*a* of the base 5.

In plasma arc welding, a shield plate 7 is used, as shown in FIG. 2. For example, a plate made of a copper alloy having a hole in its center is used as the shield plate 7. In this hole, an insulator having an opening, for example, a ring 8 made of a ceramic material (hereinafter, referred to as a ceramic ring) is provided.

After the lead wire 6 is drawn out of the eyelet 5*a* of the base 5, the shield plate 7 is provided on the eyelet 5*a*. In this case, the eyelet 5*a* and the shield plate 7 are electrically connected, and the shield plate 7 has been cooled with water. The protruded tubular portion 5*d* of the eyelet 5*a* is inserted into the opening of the ceramic ring 8. The lead wire 6 is inserted through the opening of the tubular portion 5*d*. The distance from the bottom end of the tubular portion 5*d* to the edge of the plasma torch 10 preferably is 5 mm to 10 mm.

In the above embodiment, the tubular portion 5*d* provided in the eyelet 5*a* is formed by pressing as an integral part of the eyelet 5*a*. However, as shown in FIG. 3, a conventional eyelet having a flat top portion can be used. In this case, a tubular sleeve 9 having an outer diameter of 1 mm to 2 mm is mounted on the lead wire 6 drawn from the eyelet 5*a* of the base 5. Furthermore, a brim portion 9*a* having an increased outer diameter of 2 mm to 3 mm can be provided at one end of the sleeve 9, and a recess 5*e* can be provided at the edge of the opening of the eyelet 5*a* so that the brim portion 9*a* can be engaged therein. This makes it easy to fit in the sleeve 9 properly during the production process. Also in the case where the sleeve 9 is used, the shield plate 7 is provided on the eyelet 5*a* of the base 5 for plasma arc welding, as in the above-described embodiment. In this case, the sleeve 9 provided in the eyelet 5*a* is inserted into the opening of the ceramic ring 8 provided in the shield plate 7. The lead wire 6 is inserted through the sleeve 9, and the end of the lead wire 6 is projected outwardly from the end of the sleeve 9.

As described above, after the shield plate 7 is provided on the eyelet 5*a*, plasma arc welding is performed. Discharge for plasma arc welding is directed from the end of a plasma torch 10 to the lead wire 6, or the tubular portion 5*d* or the end of the sleeve 9, and the heat of plasma arc generated by the discharge fuses the lead wire 6 and the entire tubular portion 5*d* or sleeve 9, so that the lead wire 6 and the tubular portion 5*d* or the sleeve 9 are welded at the top portion of the eyelet 5*a*. The opening of the eyelet 5*a* is completely closed by the fusion of the tubular portion 5*d* or the sleeve 9 and the lead wire 6.

As for the shape of the sleeve 9, a pipe-shaped straight sleeve without the brim portion 9*a* or a sleeve with longitudinal slits can be used. In this case, it is preferable that the sleeve with longitudinal slits is formed so that the outer diameter thereof is slightly larger than the diameter of the opening in the center of the eyelet 5*a* and that the outer diameter becomes slightly smaller than the diameter of the opening in the center of the eyelet 5*a* when the longitudinal slit gap is narrowed. Such a sleeve having longitudinal slits has the following advantage. When the sleeve is inserted into the opening of the eyelet 5*a* while pressing the sleeve to narrow the slit gap and then the pressing is loosened, elastic recovery occurs so that the slit gap becomes wider. This spring effect allows the sleeve to be electrically and mechanically connected to the eyelet 5*a* easily.

The thickness of the welded portion can be adjusted arbitrarily by the volume of the protruded tubular portion 5*d* or the sleeve 9, so that the thickness to fill the opening of the eyelet 5*a* completely by welding can be optimized.

When the eyelet 5*a* and the sleeve 9 contain zinc, black smoke is generated during plasma arc welding, and the black smoke is adhered to the plasma torch 10 or the shield plate 7. As a result, automated welding work becomes unstable, so that welding defects increase. Therefore, it is preferable to use a metal free from zinc as the material for the eyelet 5*a* or the sleeve 9. For example, a copper alloy, which is available at a low cost and has good electrical conductivity, can be used as the material Alternatively, a metal such as stainless steel can be used.

Next, the ceramic ring 8 that is inserted into the hole of the shield plate 7 will be described.

Plasma discharge has the nature that it is directed to the nearest conductor that has a sharp end. Therefore, in the case where the ceramic ring 8 is not provided, discharge may be directed from the end of the plasma torch 10 to shield plate 7. In this case, welding becomes incomplete, resulting in defects. Therefore, the ceramic ring 8 as an insulator is provided in the hole of the shield plate 7 so as to cover the edge of the hole on the side of the plasma torch 10. Thus, the ceramic ring 8 can prevent plasma discharge from being directed to the shield plate 7.

In this embodiment, a bulb-shaped fluorescent lamp has been described. However, the present invention can be applied to general incandescent lamps, reflex lamps, high-pressure lamps or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for producing a bulb-shaped lamp, comprising forming a tubular portion that is protruded in an eyelet of a base of a bulb-shaped lamp;

drawing a lead wire out of the tubular portion;

placing a shield plate on the eyelet, the shield plate having a hole and being provided with an insulator having an opening in the hole, the tubular portion being inserted into the opening of the insulator; and fusing the lead wire and the tubular portion with the eyelet by plasma arc welding after placing the shield plate, wherein an edge of the hole of the shield plate on a side of the lead wire is covered with the insulator.

2. A method for producing a lamp, comprising mounting a sleeve onto a lead wire drawn out of an eyelet of a base of a lamp; and fusing the lead wire and the sleeve with the eyelet by plasma arc welding.

3. The method for producing a lamp according to claim 2, comprising placing a shield plate on the eyelet, the shield plate having a hole and provided with an insulator having an opening in the hole, in such a manner that the sleeve is inserted into the opening of the insulator, before the process of fusing the lead wire and the sleeve with the eyelet by plasma arc welding.

* * * * *